United States Patent [19]

Bolois

[11] Patent Number: 4,733,678

[45] Date of Patent: Mar. 29, 1988

[54] PATCH BAY JACK CLEANING TOOLS

[76] Inventor: Charles S. Bolois, 5444 Simpson Ave., North Hollywood, Calif. 91607

[21] Appl. No.: 829,321

[22] Filed: Feb. 14, 1986

[51] Int. Cl.[4] ..... B08B 3/00

[52] U.S. Cl. ..... 134/115 R; 206/234; 134/8; 15/210 R; 15/236 R; 29/90 R; 239/602

[58] Field of Search ..... 134/8, 9, 6, 22.11, 134/22.12, 24, 26, 32, 33, 115 R; 169/70; 239/271, 602; 29/90 R, 90 A; 15/160, 210 R, 236 R; 206/234

[56] References Cited

U.S. PATENT DOCUMENTS

| | | | |
|---|---|---|---|
| 509,899 | 12/1893 | Heysinger | 29/90 R |
| 1,171,146 | 2/1916 | Scribner | 29/90 R |
| 2,117,648 | 5/1938 | Bottorf | 51/411 |
| 2,968,441 | 1/1961 | Holcomb | 239/602 |
| 3,606,708 | 9/1971 | Plichta et al. | 29/90 R |
| 3,751,781 | 8/1973 | Koppelmann | 29/90 R |
| 4,625,808 | 12/1986 | Halfpenny | 239/271 |

*Primary Examiner*—Frederick R. Schmidt
*Assistant Examiner*—William E. Terrell
*Attorney, Agent, or Firm*—John J. Posta, Jr.

[57] ABSTRACT

A pair of tools are disclosed for cleaning an electrical jack having multiple contacts physically touching an inserted plug as well as additional breaking contacts not physically touching the plug. A burnishing tool is interted into the jack and twisted, the burnishing surface of the burnishing tool thereby cleaning the contacts physically touching the plug. Following removal of the burnishing tool, an injector tool is inserted into the jack, and pressurized solvent from an aerosol can is directed through an internal channel in the injector tool and directed from multiple holes also in the injector tool onto the breaking contacts to clean them.

10 Claims, 4 Drawing Figures

22
30
40
38
32
34
44
24
42
46
28
36
20
26
16
14
12
10

52
50
54

24
72
68
74
66
64
76
70
60
62
82
80
84

61
71
81

PATCH BAY JACK CLEANING TOOLS

BACKGROUND OF THE INVENTION

Field of the Invention

The present invention relates generally to apparatus for cleaning electrical contacts, and more particularly to tools for conveniently cleaning electrical jacks such as the ¼ inch TRS and the Bantam (TT) patch jacks found in recording and broadcast equipment without requiring the disassembly of the equipment, and without resulting in contaminants being left in the equipment, which contaminants could cause shorting of the equipment.

Recording and broadcast facilities typically utilize a large number of discrete electrical and electronic components permanently mounted in racks or consoles and called, collectively, a patch bay. These components are interconnected with patch cords as needed for the particular purpose for which the facility is being used. The patch cords, which have electrical plugs at both ends, are plugged into jacks in the patch bay, which jacks are the inputs and outputs of the various components contained in the patch bay.

It may thereby be appreciated that electrical signal flow may be routed through selected components in the patch bay by inserting the patch cords between the selected components to conveniently and quickly create a customized recording or broadcast circuit for a particular recording session or broadcast. This process is analgous to the operation of an old-fashioned telephone switchboard, where an operator made connections by patching a calling party's line to the desired receiving party's line via a patch cord.

The patch jacks contained in the patch bay are typically mounted in rows of approximately 24 across on a 19 inch wide rack, with the jacks being hard wired to the various electrical and electronic components. Since each patch jack typically has five signal routing wires coming from the jack and going to the input or the output of a component, it may be appreciated that the interior of a patch bay is quite congested with the various wires. The density of the wiring connected to the patch jacks therefore makes them relatively inaccessible, except from the front where a patch cord plug may be plugged in.

Since patch bay apparatus has an extended life, a problem that has arisen is that of surface deterioration of the electrical contacts of the patch jacks contained in the patch bay. Unlike the patch cord plugs, which may easily be cleaned, the jacks are inaccessible due to the wiring density and to their design. Patch bay jacks typically have three contacts which physically touch the patch cord plug to make electrical connections. One of these three contacts is a cylindrical barrel contact. In addition, when the patch cord plug is inserted, two pairs of normally closed breaking contacts are opened. The various contacts are placed on five contact arms extending from a jack mounting block.

Normal exposure of the patch bay jacks to the ambient atmosphere will cause corrosion over time. In addition, it is likely that spills may occur which will leave contaminants on the jack contacts, inhibiting good electrical contact. Other undesireable elements may also find their way into the patch bay, and it is therefore apparent that the periodic cleaning of the patch bay jacks is a requirement of normal equipment maintenance.

Known techniques for cleaning electrical contacts generally use an abrasive material mounted on a surface rubbed against the contact. Specifically, U.S. Pat. No. 2,503,299 to Rodriquez, U.S. Pat. No. 2,734,320 to Hoye, and U.S. Pat. No. 4,263,692 to Gremillion illustrate various types of devices using abrasive materials. The use of such approaches for cleaning patch bay jack contacts is impractical for several reasons.

First, it would be difficult to mount abrasive material on the irregular contour of a patch cord plug. Abrasive material wearing off during the cleaning operation may have serious effects of the electronic equipment contained in a patch bay. The references mentioned above are useful for removing fairly heavy corrosion from solid posts or heavy contacts, but are simply too brute force a technique for the sensitive electrical contacts of patch bay jacks. Finally, such an approach would be totally ineffective to clean the breaking contacts of a patch bay jack, which breaking contacts are not physically touched by the patch cord plug.

Two techniques have been used to clean patch bay jacks with a degree of success. The first of these is the use of a segment of steel in the shape of a patch plug but slightly oversize, with a slot cut through a diameter of the segment. The slot is compressed slightly when the segment is inserted into the jack, producing a knife edge effect cleaning action. This tool cleans two of the three contacts touching the plug, leaving the cylindrical barrel contact and the two pairs of breaking contacts untouched.

The other technique involves the use of a brush similar to a gun cleaning brush, which is inserted into the jack. While this is effective to clean the cylindrical barrel contact, it also does not clean the two pairs of breaking contacts. In addition, some metal bristles of the cleaning brush may fall out, causing shorts within the patch bay. This problem makes the use of such a brush quite undesirable.

It may therefore be appreciated that it is desireable to have an inproved tool or tools for cleaning the contacts of a patch bay jack. It is essential that the tool or tools be useable from the front of the patch bay, without requiring any disassembly. All of the contacts must be cleanable from this location, including the hard-to-reach breaking contacts. The technique should be as quick, easy, and convenient as possible, and further the tool or tools should be relatively inexpensive.

SUMMARY OF THE INVENTION

The present invention utilizes two tools to completely and effectively clean all of the contacts of a patch bay jack. The first tool is a burnished tool in the shape of a patch cord plug but with a handle attached. A burnished surface on the burnished tool removes corrosion from the three contacts of the jack with touch the patch cord plug. The burnished tool is inserted and twisted to clean the contacts, and then removed.

The second tool is an injector tool for use in conjunction with an aerosol can of spray solvent of the type commonly used to clean electrical contacts. The injector tool is also in the shape of a patch cord plug, but has a channel running therethrough into which may be inserted an extended spray tube used with the aerosol can of spray solvent. The channel has two outlets, one of which is at the tip of the injector tool and is directed toward one set of breaking contacts, the other of which outlets is on the side of the injector tool at a location near the tip and directed toward the other set of breaking contacts.

A position indexing mark is provided on the handle of the injector tool to orient the other of the outlets in the proper direction for cleaning. When the injector tool is inserted ond properly oriented, solvent is sprayed from the aerosol can into the injector tool, which directs the solvent onto the two pairs of breaking contacts, which are open since the injector tool has been inserted into the jack.

It may be appreciated that the two tools of the present invention thoroughly clean all of the contacts of the patch bay jack in a simple, quick, and convenient two step operation. No disassembly of the patch bay is required, and there are no adverse effects resulting from the cleaning operation. The tools are relatively inexpensive, and the cost may be quickly recovered by the greatly reduced time required to perform the cleaning operation. Tools may be manufactured to fit any of a variety of different jack sizes and types.

DESCRIPTION OF THE DRAWINGS

These and other advantages of the invention are best understood with reference to the drawings, in which.

DETAILED DESCRIPTION OF THE PREFERRED EMBODIMENT

Figures 1, 2, 3, 4:
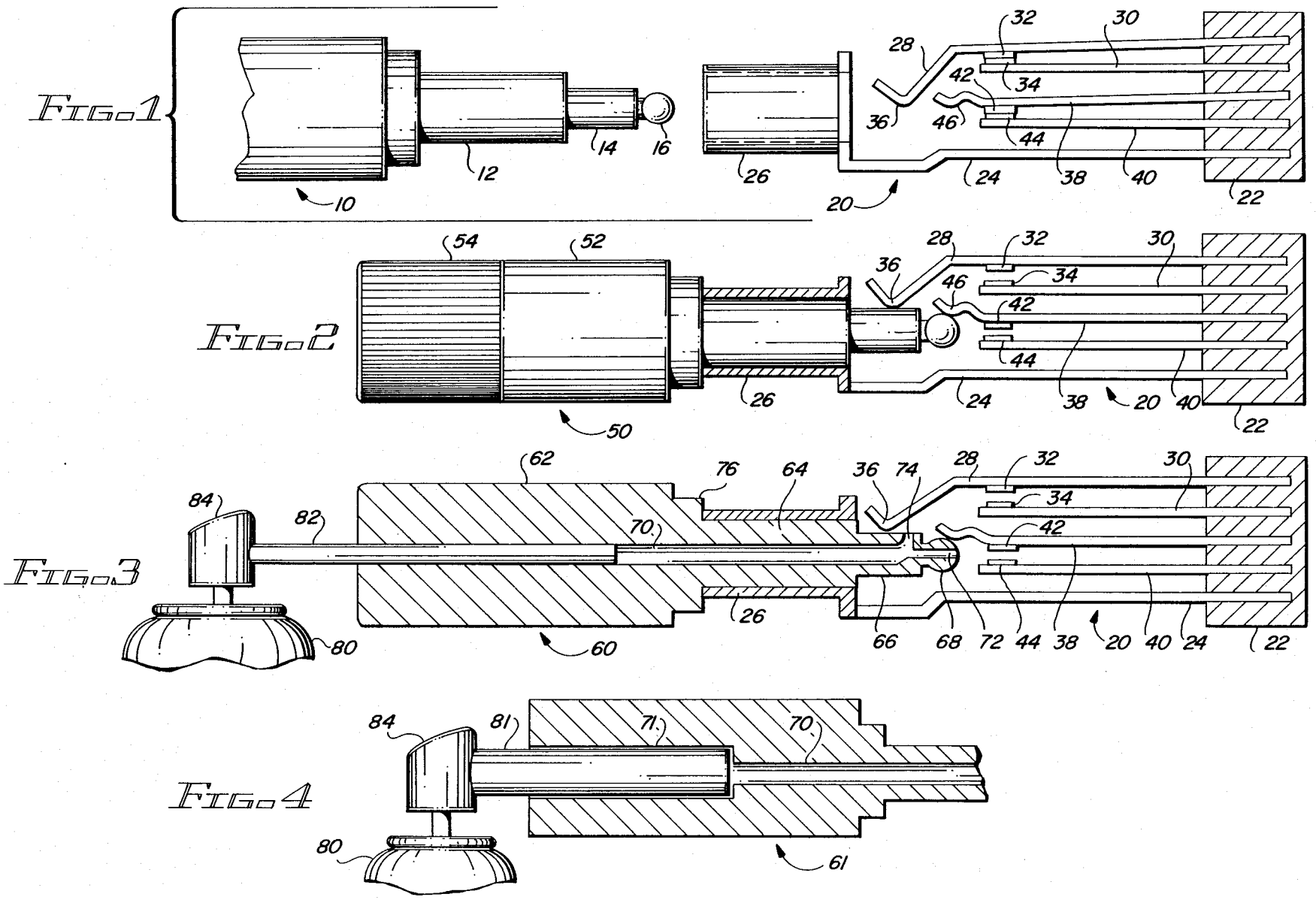
FIG. 1 is a side view of a ¼ inch TRS patch cord plug and a matching jack, the latter of which is shown with a cutaway base and the breaking contacts closed since the plug is not inserted into the jack.
FIG. 2 is a side view of the jack of FIG. 1 with the burnishing tool inserted and the cylindrical large barrel contact of the jack cut away for clarity.
FIG. 3 is a side view of the jack of FIG. 1 with the injector tool inserted and the cylindrical large barrel contact of the jack cut away for clarity.
FIG. 4 is another side view of the jack of FIG. 1, showing a stepped internal channel for receiving different sized spray can tips.

A plug 10 is illustrated in FIG. 1, which plug 10 has three conductive segments, each of which is insulated from the other two. A large barrel 12 is the first conductive segment, a small barrel 14 is the second conductive segment, and a round tip 16 is the third conductive segment. Each of the conductive segments is connected to a separate wire in a patch cord (not shown) attached to the plug 10.

Also shown in FIG. 1 is a jack 20 into which the plug 10 may selectively be inserted. The jack 20 has a base 22 for supporting the various contacts and contact arms which will now be described. A large barrel contact arm 24 extends from the base 22, and is connected to a cylindrical large barrel contact 26. The cylindrical large barrel contact 26 is sized to snugly admit the large barrel 12 while making electrical contact with the large barrel 12.

A small barrel contact arm 28 extends from the base 22, as does a first breaking contact arm 30. A first pair of breaking contacts 32, 34 are mounted with the contact 32 on the small barrel contact arm 28 and the contact 34 on the first breaking contact arm 30. The small barrel contact arm 28 is normally angled toward the first breaking contact arm 30, causing the first pair of breaking contacts 32, 34 to be normally closed.

As the plug 10 is inserted into the jack 20, the small barrel 14 will make electrical contact with a contact point 36 on the small barrel contact arm 28, moving the small barrel contact arm 28 upward and opening the first pair of breaking contacts 32, 34.

A tip contact arm 38 extends from the base 22, as does a second breaking contact arm 40. A second pair of breaking contacts 42, 44 are mounted with the contact 42 on the tip contact arm 38 and the contact 44 on the second breaking contact arm 40. The tip contact arm 38 is normally angled toward the second breaking contact arm 40, causing the second pair of breaking contacts 42, 44 to be normally closed.

As the plug 10 is inserted into the jack 20, the tip 16 will make electrical contact with a contact point 46 on the tip contact arm 38, moving the tip contact arm 38 upward and opening the second pair of breaking contacts 42, 44.

A burnishing tool 50 shown in FIG. 2 is made of steel machined in the shape of the plug 10, with a burnishing finish on the portions of the burnishing tool 50 corresponding to the large barrel 12, the small barrel 14, and the tip 16 of the plug 10. The burnishing finish is preferably applied to the burnishing tool 50 by powder blasting the portion needing the burnishing finish. For extra durability, the burnishing tool is then chrome plated in the preferred embodiment.

The burnishing tool 50 is inserted into the jack 20 while holding a handle portion 52 of the burnishing tool 50, and twisted a few times to clean the cylindrical large barrel contact 26, the small barrel contact 36, and the tip contact 46. In the preferred embodiment the handle 52 includes a serrated portion 54 to provide a better grip. If the cylindrical large barrel contact 26 has a great deal of corrosion or contaminant thereon, the burnishing tool 50 may be twisted in an elliptical fashion while it is being inserted to more effectively clean the cylindrical large barrel contact 26.

Following the use and removal of the burnishing tool 50, an injector tool 60 preferably made of stainless steel is inserted into the jack 20 as shown in FIG. 3 while holding a handle portion 62 of the injector tool 60, which may also have thereon a serrated portion (not shown). The injector tool 60 is machined to have a large barrel portion 64 corresponding to the large barrel 12 of the plug 10, a small barrel portion 66 corresponding th the small barrel 14 of the plug 10, and a tip portion 68 corresponding to the tip 16 of the plug 10. As the injector tool 60 is inserted into the jack 20, the small barrel portion 66 portion causes the small barrel contact arm 28 to move upwards opening the first pair of breaking contacts 32, 34, and the tip portion 68 causes the tip contact arm 38 to move upwards opening the second pair of breaking contacts 42, 44. It is essential that the injector tool 60 opens the two pairs of breaking contacts 32, 34 and 42, 44 so that they may be cleaned.

The injector tool 60 contains an internal channel 70 drilled from the end of the injector tool 60 having the handle 62. The channel 70 extends through the large barrel portion 64 and the small barrel portion 66. A first hole 72 drilled through the end of the tip portion 68 communicates with the channel 70. A second hole 74 is drilled through the small barrel portion 66 to the channel 70. The second hole 74 is approximately perpendicular to a central axis of the injector tool 60 and is located near the end of the small barrel portion 66 adjacent the tip portion 68.

An indexing mark 76 aligned with the second hole 74 is provided on the handle 62 to allow easy visual alignment of the injector tool 60 in the jack 20. A can 80 of aerosol spray solvent having an extended spray tube 82 attached to the spray head 84 of the can 80 is utilized for cleaning the contacts. The channel 70 is of a size to snugly accomodate the extended spray tube 82, which is inserted into the channel 70. The spray head 82 is depressed, and pressurized solvent travels through the channel 70 and out of the injector tool 60 through the first hole 72 and the second hole 74.

Solvent leaving through the first hole 72 is directed onto the second pair of breaking contacts 42, 44. Solvent leaving through the second hole 74 is directed by the small barrel contact arm 28 onto the first pair of breaking contacts 32, 34. The contacts are thereby cleaned, and the injector tool 60 may be removed from the jack 20.

An alternative design of tool 60 is shown in FIG. 4, wherein an additional channel 71 is provided in tool 61 which is aligned with channel 70, but has a larger diameter. The larger diameter of channel 71 enables the reception therein of a second, different sized spray tube 81, thereby providing a more adaptable tool 61.

Alternative approaches to the present invention include the provision of a diametrically oriented slot in the burnishing tool 50, the slot being compressed slightly when the burnishing tool 50 is inserted into the jack 20, producing a knife edge effect cleaning action. Additionally, in the injector tool 60 the second hole 74 may be angled to direct solvent directly onto the first pair of breaking contacts 32, 34. Finally, the size of holes 72, 74 may be reduced to cause a more intense spray to be emitted therefrom, with that the holes 72, 74 being relatively small in comparison to the channel 70.

It will be apparent to those skilled in the art that a number of changes, modifications, or alterations to the present invention as described herein may be made, none of which depart from the spirit of the present invention. All such changes, modifications, and alterations should therefore be seen as within the scope of the present invention.

What is claimed is:

1. A kit of tools for cleaning the contacts of an electrical jack having a cylindrical large barrel contact, a small barrel contact, and a tip contact for respective physical contact with the large barrel, small barrel, and tip of an electrical plug inserted into said jack, said electrical jack also having first and second pairs of breaking contacts which open when said plug is inserted into said jack, said tools comprising:

a burnishing tool having a handle portion, a large barrel portion, a small barrel portion, and a tip portion, said burnishing tool for insertion into said jack to cause said large barrel portion to contact said cylindrical large barrel contact, said small barrel portion to contact said small barrel contact, and said tip portion to contact said tip contact, said large barrel portion, said small barrel portion, and said tip portion having burnishing surfaces thereon, said burnishing tool being rotatable by said handle to cause said burnishing surfaces to clean said cylindrical large barrel contact, said small barrel contact, and said tip contact; and an injection tool having a handle portion, a large barrel portion, a small barrel portion, and a tip portion, said injection tool for insertion into said jack to cause said first and second pairs of breaking contacts to open, said injection tool having a channel disposed therein through said handle, said large barrel portion, and said small barrel portion, said channel being specifically arranged and configured to be supplied with pressurized solvent from an extended spray tube connected to the spray head of an aerosol spray can of solvent, said tip portion of said injection tool having a first hole through the end thereof leading from said channel for directing said solvent onto said second pair of breaking contacts, said small barrel portion of said injection tool having a second hole therethrough leading from said channel for directing said solvent onto said first pair of breaking contacts.

2. Tools as defined in claim 1, wherein said burnishing tool is made of steel and said burnishing surfaces are steel with a powder blasted surface.

3. Tools as defined in claim 2, wherein said burnishing tool is chrome plated.

4. Tools as defined in claim 1, wherein said handle includes a grip portion having serrated lines thereon.

5. Tools as defined in claim 1, wherein said burnishing tool has a slot cut through a diameter of the burnishing tool, said slot being compressed slightly when said segment is inserted into said jack, producing a knife edge effect cleaning action.

6. Tools as defined in claim 1, wherein said first and second holes are relatively small in comparison with said channel.

7. Tools as defined in claim 1, wherein said second hole is angled in said small barrel portion to direct said solvent onto said first pair of breaking contacts.

8. Tools as defined in claim 1, wherein said injector tool has an indexing mark located on the handle thereof to facilitate proper alignment of said second hole.

9. Tools as defined in claim 1, wherein said injector tool is made of stainless steel.

10. Tools as defined in claim 1 wherein said handle portion of said injection tool has a first and second channel disposed therein, said first and second channels being in alignment with one another, said second channel having a larger diameter than said first channel, whereby said channels are adapted to receive therein different sized spray tubes.

* * * * *